US005301627A

United States Patent [19]

Czipri

[11] Patent Number: 5,301,627

[45] Date of Patent: Apr. 12, 1994

[54] RETRACTABLE BOAT CLEAT

[75] Inventor: John Czipri, Clearwater, Fla.

[73] Assignee: Accon, Inc., Clearwater, Fla.

[21] Appl. No.: 112,267

[22] Filed: Aug. 27, 1993

[51] Int. Cl.[5] ..... B63B 21/04

[52] U.S. Cl. ..... 114/218

[58] Field of Search ..... 114/218, 219, 221 R, 114/230; 410/55, 85, 96, 101, 102, 106, 107, 108, 110, 111, 116; 24/115 R, 115 G, 115 K, 136 K

[56] References Cited

U.S. PATENT DOCUMENTS

| | | | |
|---|---|---|---|
| 2,729,417 | 1/1956 | Maynard | 410/111 |
| 4,809,634 | 3/1989 | Czipri | 114/218 |
| 4,820,094 | 4/1989 | Hirakui et al. | 410/107 |
| 4,890,566 | 1/1990 | Morris | 114/218 |
| 4,945,849 | 8/1990 | Morris et al. | 114/218 |
| 5,004,388 | 4/1991 | Harris | 410/107 |
| 5,106,248 | 4/1992 | Harris | 410/107 |

*Primary Examiner*—Edwin L. Swinehart
*Attorney, Agent, or Firm*—Harold D. Shall

[57] ABSTRACT

A cleat assembly having a base plate for receiving the cleat of the assembly. The base plate has a body portion for receiving the shank of the cleat and a pair of slots for receiving a pin carried by the shank. A single "W" shaped spring engages one of the ends of the pin and is operative to alternately hold the cleat in its exposed operative position or in its depressed inoperative position.

5 Claims, 2 Drawing Sheets

RETRACTABLE BOAT CLEAT

BACKGROUND OF THE INVENTION

1. Field of the Invention

This invention relates to boat cleats in general and more particular to a cleat which has an exposed operative position and a depressed inoperative position wherein it is flush and is not an obstruction.

2. State of the Prior Art

There are many different types retractable cleats, but none of them are as strong and durable as the cleat of this invention nor are vertically moveable and have a single spring which both keeps the cleat in its exposed operative position and also serves to hold the cleat in its depressed inoperative position.

SUMMARY OF THE INVENTION

The present invention provides a cleat which has a depressed or concealed position and an upright or exposed operative position, the cleat being manually operable between such positions and includes a single spring with a pair of detents therein with each detent serving to hold the cleat in one of its positions resulting in a strong compact structure.

DETAILED DESCRIPTION

Figure 1:
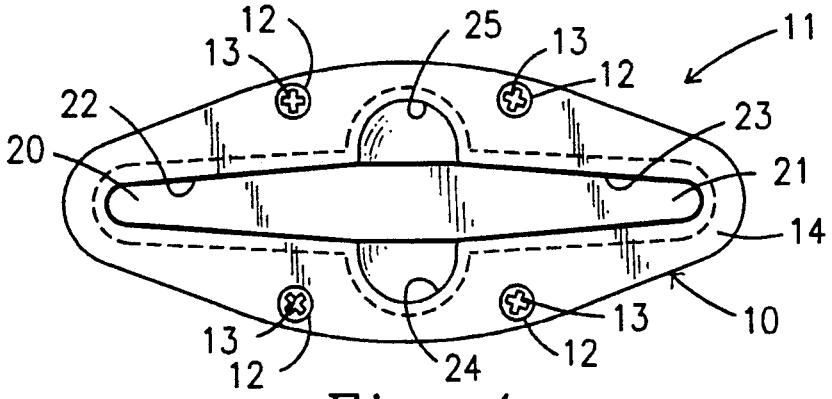
FIG. 1 is a plan view of this invention with the cleat in its depressed or flush position.

Referring now to the drawings, a base plate of a cleat assembly 11 is shown at 10. As seen in FIG. 1, the base plate 10 has four countersunk attaching holes 12 each receiving a bolt 13 passing through the deck of a boat (not shown); the deck (not shown) having a suitable opening receiving the assembly 11 and having an edge around the opening to which the base plate is secured. The base plate 10 is of one piece construction and has a peripheral flange 14 depending from which is a body portion 15. The body portion 15 has a pair of opposed slots 16 and 17 therein which slots extend vertically and end below the top and above the bottom of the body portion 15.

Figure 2:
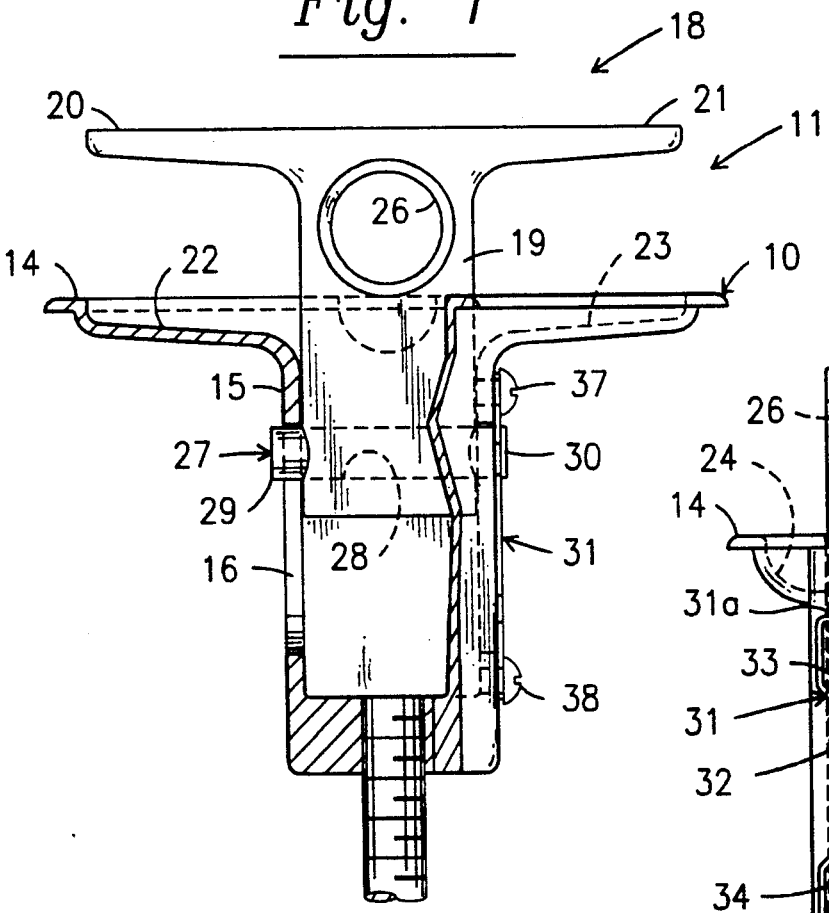
FIG. 2 is a front elevational view of this invention with portions broken away for added clarity and with the cleat in its upright or exposed position.
Figure 3:
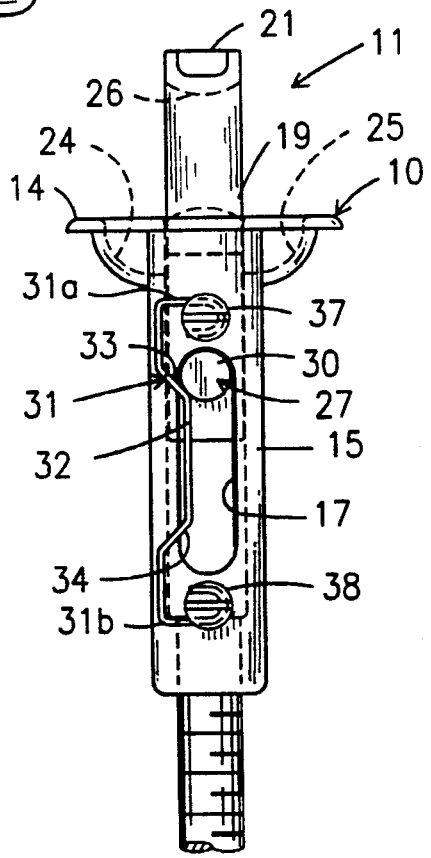
FIG. 3 is a side elevational view of this invention with the cleat in its exposed position.
Figure 4:
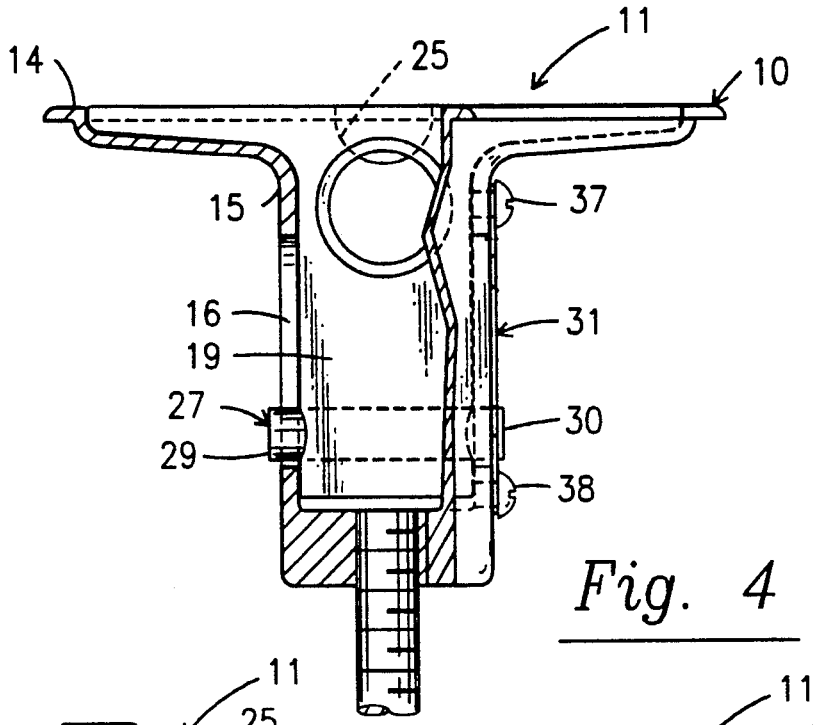
FIG. 4 is a front elevational view of this invention with portions broken away for added clarity with the cleat in its depressed or flush position.
Figure 6:
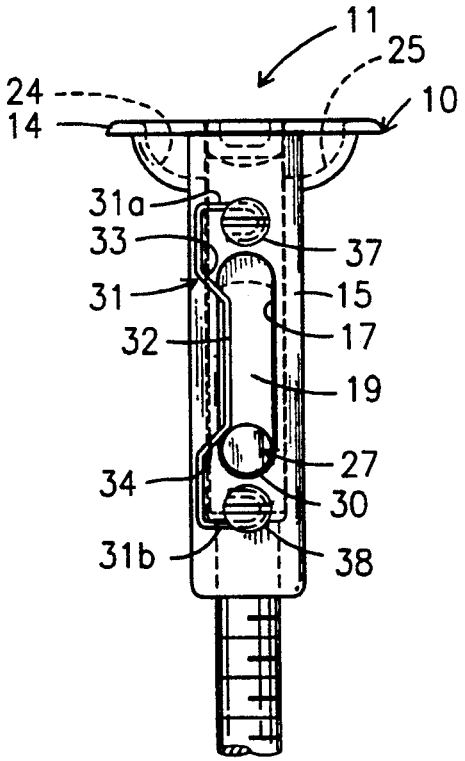
FIG. 6 is a side elevational view of this invention with the cleat in its depressed or flush position.

A cleat 18 is carried for reciprocal movement by the base plate 10 and body portion 15 and has a elongated shank portion 19 and extending from the top of the shank portion is a pair of opposed cleat legs 20 and 21 to which a line (not shown) can be secured for docking or boat lifting purposes. The legs 20 and 21 are received in depressions 22 and 23 when the cleat assembly 11 is in its flush position as shown in FIGS. 4 and 6. The flange 14 is provided with a pair of opposed access openings 24 and 25 which provide finger access thereinto when the cleat assembly is in its flush position so that the operator may insert his fingers into the access openings and grasp an opening 26 in the cleat 18 to thereby pull the cleat to its upright position of FIGS. 2 and 3. To depress the cleat 18, the operator merely presses upon the top of the cleat 18 and forces the shank portion 19 of the cleat 18 down into the body portion 15 of the base plate 10.

A guide and locking pin 27 is carried by a laterally extending opening 28 formed in the shank portion 19 of the cleat 18, which locking pin 27 extends laterally beyond the sides of the shank 19, with the opposed ends 29 and 30 of the locking pin being slidingly and guidingly received respectively in the slots 16 and 17 of the body portion 15 of the base plate 10.

Secured to the right side of the body portion 15 of the base plate 10 adjacent to the slot 17 is an elongated spring shown generally at 31. The spring 31 is of elongated "W" shaped, with the center loop 32 of the "W" being substantially elongated and overlying the adjacent slot 17 thereby forming a pair of oppositely facing cam surfaces 33 and 34 at the top and bottom of the loop respectively. The spring 31 is secured at its opposed ends 31*a* and 31*b* to the body portion 15 at the opposed ends of the slot 17 by a pair of screws 37 and 38.

Figure 5:
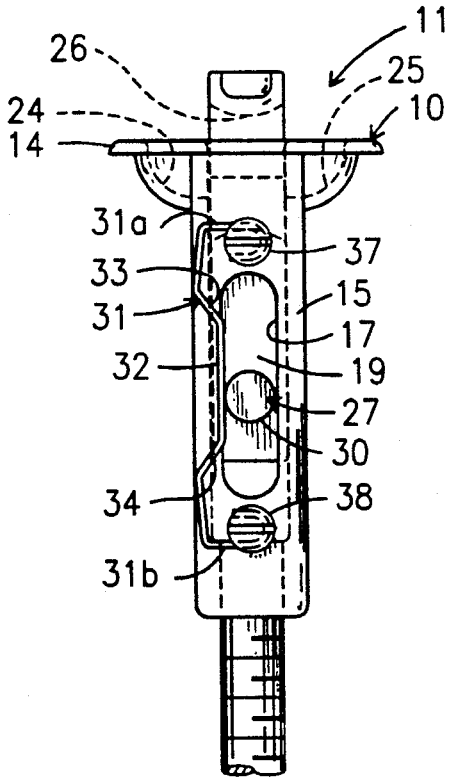
FIG. 5 is a side elevational view of this invention with the cleat in a position intermediate its upright and depressed positions.

As seen in FIG. 5, when the cleat 18 is intermediate its exposed and depressed portions,the end 30 of the pin 27 rides on top of the loop 32. When the cleat 18 is in its fully exposed position of FIGS. 2 and 3, the end 30 of the pin 27 engages the cam surface 33 of the spring 31 and the upper end of the slot 17 and the spring 31 thus resiliently holds the cleat 18 in its exposed position. When the cleat 18 is in its fully depressed position of FIGS. 4 and 6, the end 30 of the pin 27 engages the cam surface 34 of the spring 31 and the lower end of the slot 17 and the spring 31 thus resiliently holds the spring in its depressed position. It is thus seen that a single spring 31 holds the cleat 18 in either its exposed or depressed position and resiliently inhibits the cleat from moving to its other position and resiliently inhibits the cleat from rattling in the cleat assembly.

Although the foregoing description relates to a presently preferred embodiment, modifications can be made therein without departing from the spirit of the invention as defined in the following claims:

What is claimed is:

1. A retractable boat cleat assembly having a depressed position and an exposed position and being moveable between such positions comprising, a) a base plate having a flange portion for securing to a boat hull and a hollow body portion depending from said flange portion, b) said body portion having a pair of laterally opposed vertically extending slots therein, c) a cleat having opposed laterally extending cleat legs and a shank portion extending downwardly from said legs with said shank portion being received in said body portion for relative reciprocal movement upon manual manipulation, d) pin means having opposed ends and being carried by said shank portion and with the opposed ends thereof extending guidingly into said vertically extending slots, e) and a resilient member carried by said body portion and overlying one of said vertically extending slots and being engageable with said pin means at all times, f) said resilient member having a pair of opposed cam surfaces thereon with one surface resiliently engaging said pin means when said cleat is in its exposed position and the other surface resiliently engaging said pin means when said cleat is in its depressed position.

2. A cleat assembly according to claim 1 wherein said resilient member is of elongated "W" shape with the center loop thereof being elongated and having a said pair of opposed cam surfaces formed at the ends of said center loop.

3. A cleat assembly according to claim 2 wherein said vertically extending slots have an upper and lower end and said resilient member holds said pin against the upper end of said slots when said cleat is in its exposed position and holds said pin against the lower end of said slots when said cleat is in its depressed position.

4. A cleat assembly according to claim 1 wherein said base plate has access opening means therein for manually reaching said cleat and moving the same from its depressed to its exposed position.

5. A cleat assembly according to claim 3 wherein said base plate has access opening means therein for manually reaching said cleat and moving the same from its depressed to its exposed position.

* * * * *